US009605386B2

(12) United States Patent
Krusniak et al.

(10) Patent No.: US 9,605,386 B2
(45) Date of Patent: Mar. 28, 2017

(54) RAIL VEHICLE HAVING ROLLER CLAMP ASSEMBLY AND TOWING ARM

(71) Applicant: Harsco Corporation, Camp Hill, PA (US)

(72) Inventors: Mark S. Krusniak, Manistee, MI (US); Kevin A. Hansen, Ludington, MI (US)

(73) Assignee: Harsco Corporation, Camp Hill, PA (US)

( * ) Notice: Subject to any disclaimer, the term of this patent is extended or adjusted under 35 U.S.C. 154(b) by 218 days.

(21) Appl. No.: 14/457,990

(22) Filed: Aug. 12, 2014

(65) Prior Publication Data

US 2016/0047091 A1 Feb. 18, 2016

(51) Int. Cl.
*E01B 27/16* (2006.01)
*E01B 27/17* (2006.01)

(52) U.S. Cl.
CPC ..... *E01B 27/17* (2013.01); *E01B 27/16* (2013.01)

(58) Field of Classification Search
CPC .. E01B 27/17; E01B 2203/10; E01B 2203/16; E01B 2203/015; E01B 29/04; E01B 31/08; E01B 27/16; E01B 27/20
See application file for complete search history.

(56) References Cited

U.S. PATENT DOCUMENTS 5,052,306 A * 10/1991 Theurer ..... E01B 27/17 104/12
5,605,099 A 2/1997 Sroka et al.
2003/0037694 A1* 2/2003 Theurer ..... E01B 27/10 104/2
2014/0013991 A1 1/2014 Delucia et al.

FOREIGN PATENT DOCUMENTS

CN 103628368 3/2014
EP 2085517 8/2009

OTHER PUBLICATIONS

International Search Report of corresponding PCT application PCT/US2015/042251 dated Nov. 5, 2015.

* cited by examiner

*Primary Examiner* — Mark Le
(74) *Attorney, Agent, or Firm* — Baker & McKenzie LLP

(57) ABSTRACT

A rail vehicle includes a frame, a clamping assembly and a towing arm coupled to the frame and selectively coupled to the clamping assembly. The towing arm is movable from a first, unengaged position to a second, engaged position. The clamping assembly includes a plurality of roller clamps that are adapted to rotate about respective central axes of the roller clamps.

13 Claims, 7 Drawing Sheets

RAIL VEHICLE HAVING ROLLER CLAMP ASSEMBLY AND TOWING ARM

BACKGROUND

The present application relates generally to a rail vehicle for performing maintenance operations, and more particularly to a tamper vehicle having a roller clamp assembly for use in lifting, aligning, cross leveling and/or applying geometric corrections (generally referred to as "surfacing and lining" operations) to railroad tracks.

Generally, a railroad includes at least one pair of elongated, substantially parallel rails coupled to a plurality of laterally extending ties, which are disposed on a ballast bed. The rails may be constructed from a plurality of rail pieces joined by joint bars to form the rails in the track direction. The rails are coupled to the ties by tie plates and spikes and/or spring clip fasteners, which is an example of a class of fasteners that may be referred to as elastic fasteners. The ballast is generally hard particulate material such as, but not limited to, granite. The ballast filled space between ties is referred to as a crib. Over time, normal wear and tear on the railroad may cause the rails to deviate from a desired geometric orientation. Further, excessive heat sometimes causes the track to deform or buckle (sometimes referred to as a sun kink).

Rail maintenance processes for addressing such concerns involve the use of machines such as a tamping machine. These machines may lift the rail to permit the carrying out of geometric corrections to the rail orientation, while also allowing tamping units to tamp the ballast bed of the tie being worked. However, such machines have been found to have limited ability in continuously lining sun kinked track.

BRIEF SUMMARY

In an embodiment, a rail vehicle includes a frame, a pair of wheels, a clamping assembly, and a tow member which may be selectively coupled to the clamping assembly. The wheels travel along a rail. The clamping assembly is coupled to the frame and includes a plurality of roller clamps depending downwardly therefrom which are adapted to roll along rail and selectively clamp thereto.

In another embodiment, a method of performing rail maintenance includes: providing a rail vehicle including a pair of wheels that travel along a rail, a clamping assembly, and a tow member, and further selectively coupling the tow member to the clamping assembly to impart additional towing force to the clamping assembly. The method further includes providing a plurality of roller clamps for engaging the rail and selectively clamping to the rail to carry out lifting and lining operations.

DETAILED DESCRIPTION

Embodiments described herein relate generally to a clamping assembly and towing arm for use with rail vehicles. The clamping assembly and towing arm described herein may be used with any type of rail vehicle that is suitable for lifting track. In one example, the clamping assembly and towing arm are used with a continuous action tamper vehicle. The clamping assembly and towing arm may also be deployed on unmanned, drone rail vehicles. In some embodiments, only the clamping assembly is provided; however, in other embodiments, the towing arm is provided to operatively engage the clamping assembly. The clamping assembly is suitable for lifting of rail in any operation. The towing arm is suitable for operatively engaging the clamping assembly in operations for addressing sun kinks or other conditions of poor track alignment.

Figure 1:
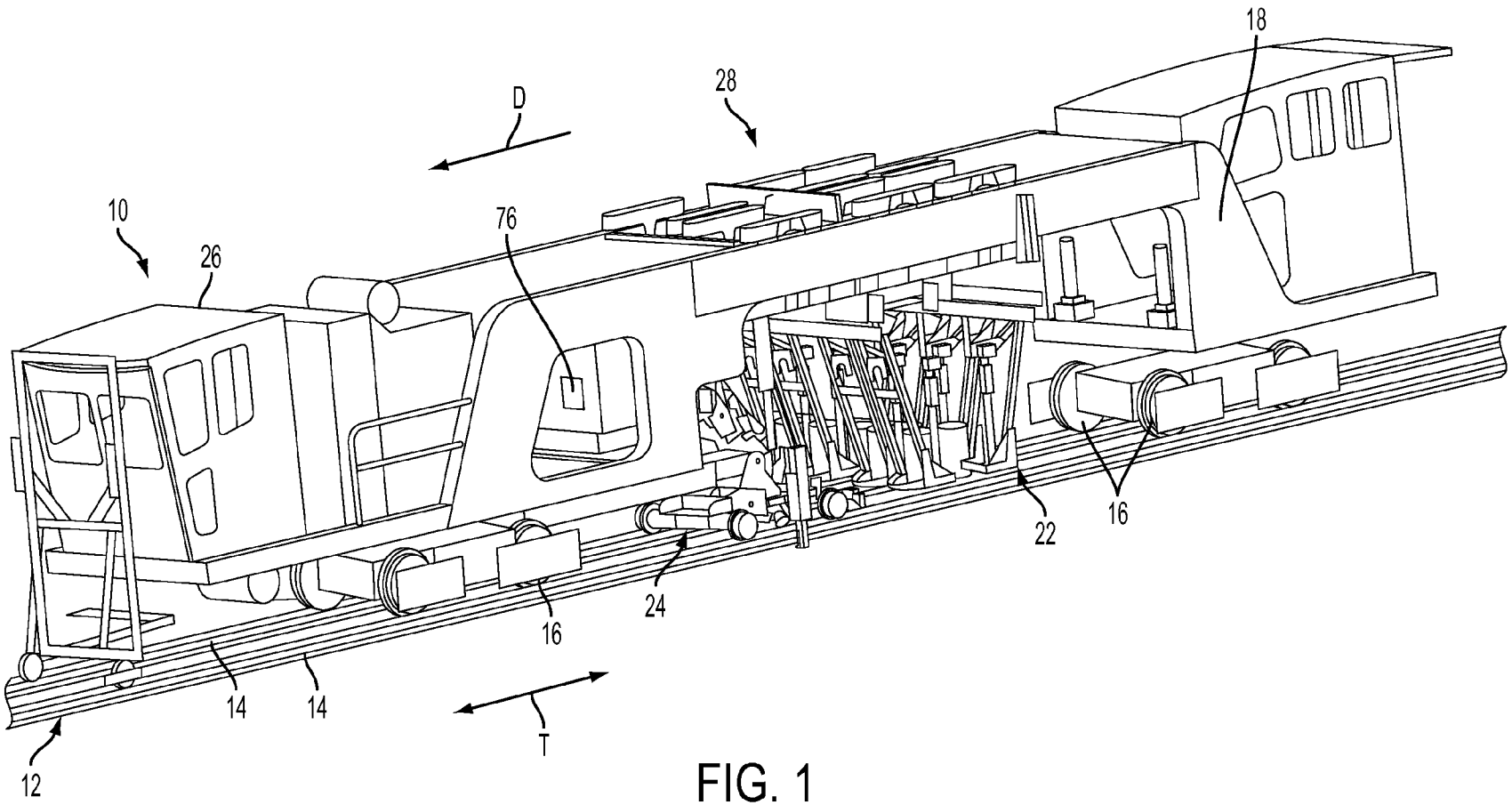
FIG. 1 illustrates a perspective view of an exemplary rail maintenance vehicle according to one embodiment of the present disclosure.

Referring to FIG. 1, a rail maintenance vehicle 10 may travel on a railroad 12. The railroad 12 may include a pair of rails 14 extending in a track direction T (also referred to herein as the longitudinal direction). The rail maintenance vehicle 10 may include a plurality of wheels 16 coupled to a frame 18 by which the rail maintenance vehicle may travel along the rails 12. A tie locator 20 (e.g., a metal detector), which provides tie locations, may be provided at a forward wheel of the rail maintenance vehicle 10. In some embodiments, the tie locator 20 dually functions as a joint bar locator. The tie locator 20 may also be provided anywhere forward (with reference to the travelling direction of the rail maintenance vehicle 10 indicated by arrow D in FIG. 1) of a work head portion 22 and clamping assembly 24. The rail maintenance vehicle 10 may include a motor to provide propulsion or may be towed or pushed by another vehicle. The rail maintenance vehicle may further include an operator cab 26. However, in other embodiments, the rail maintenance vehicle 10 may be a drone vehicle, thus obviating the need for an operator cab. In such embodiments, the rail maintenance vehicle is operated remotely without human operators on the vehicle.

The work head portion 22 may be coupled to the frame 18 by a sub-frame portion 28. The sub-frame portion 28 may be actuated to reciprocate with respect to the frame 18 by an actuator for continuous work. In this mode, the work head portion 22 may remain substantially stationary for a period of time to perform work at the site of a particular tie while the rail maintenance vehicle 10 is continuously or substantially continuously driven forward.

Figure 2:
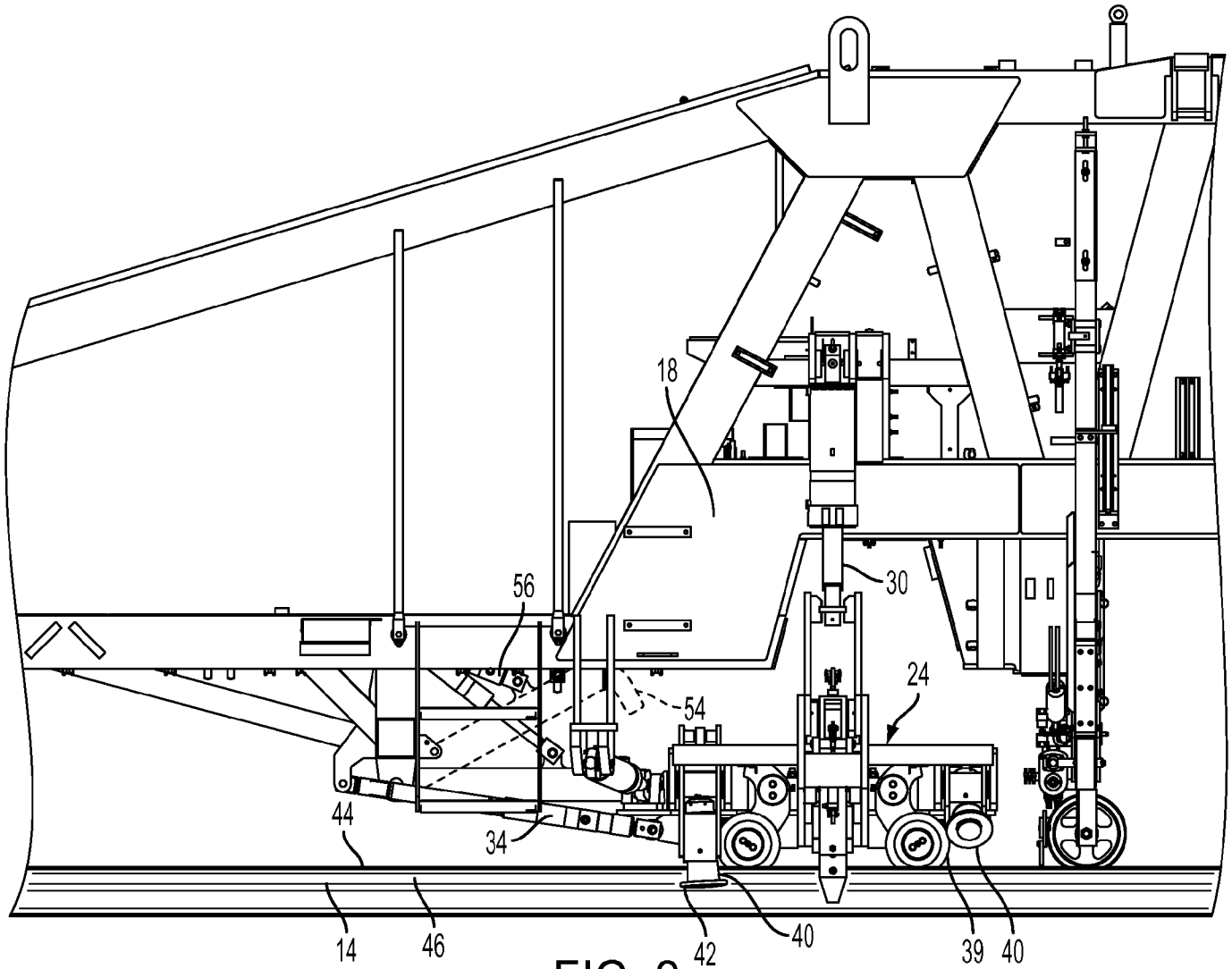
FIG. 2 illustrates a side view of an exemplary clamping assembly of the rail maintenance vehicle.
Figure 3:
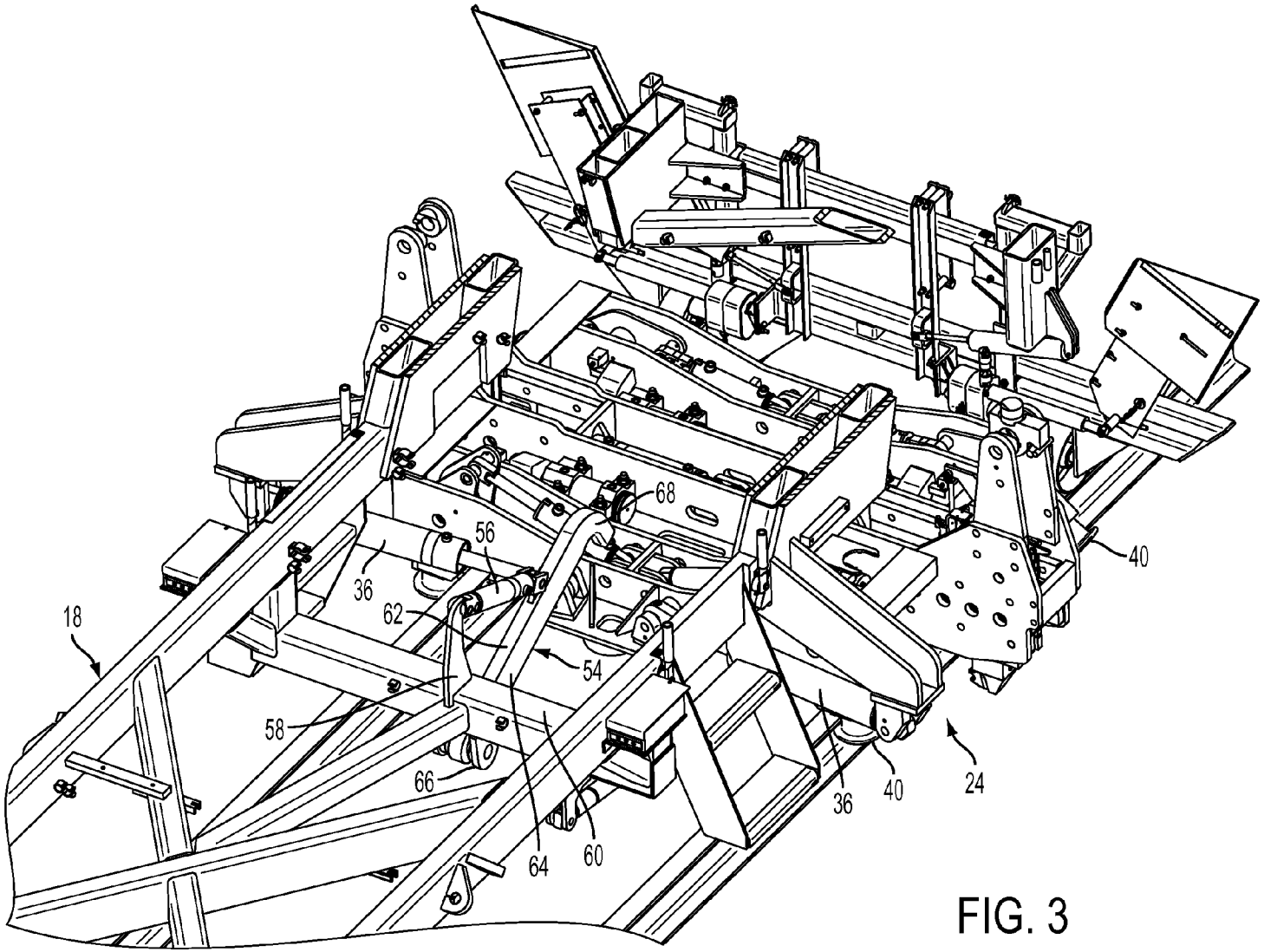
FIG. 3 illustrates a perspective view of a portion of the clamping assembly illustrating a towing arm in an unengaged position.
Figure 4:
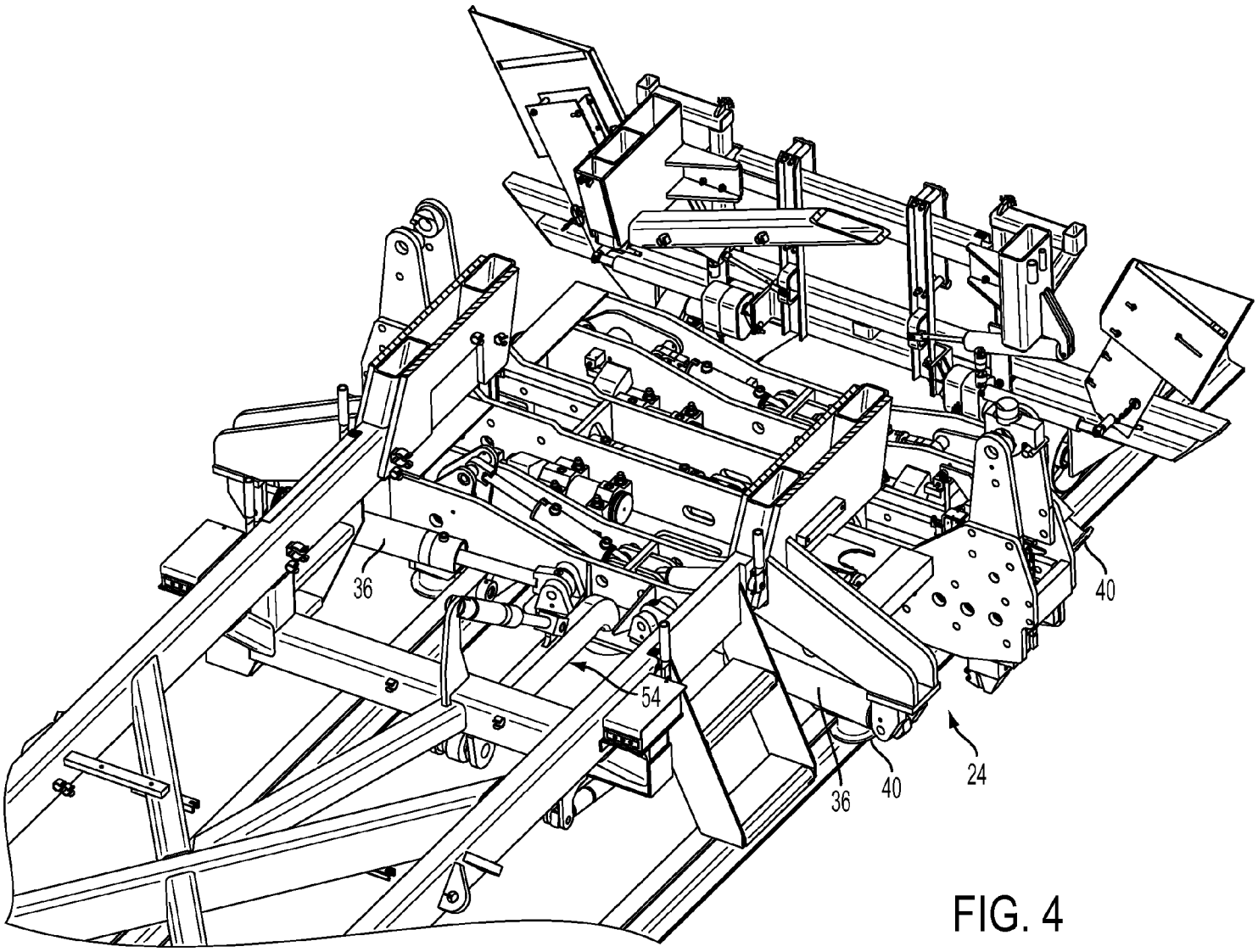
FIG. 4 illustrates a perspective view of a portion of the clamping assembly illustrating a towing arm in an engaged position.

The clamping assembly 24 is disposed forward (i.e., in the direction D) of the work head portion 22 and is operatively connected to the frame 18. Referring to FIGS. 2-4, the clamping assembly 24 is further operatively connected to a plurality of cylinders, which permit lifting, lining and skewing operations. With specific reference to FIG. 2, the clamping assembly 24 is coupled to a jack cylinder 30, which is disposed in a vertical direction relative to the rails 14. The jack cylinder 30 may be a hydraulic cylinder that can be actuated to impart vertical movement to the clamping assembly 24 as will be described. An upper portion of the jack cylinder 30 is fixedly coupled to the frame 18. A lower portion of the jack cylinder 30 is coupled to a frame 32 of the clamping assembly 24. In some embodiments, more than one jack cylinder 30 is utilized.

The clamping assembly 24 is further coupled to a skew cylinder 34, which extends forwardly of the clamping assembly and is coupled at a forward end to the frame 18. The skew cylinder 34 may be a hydraulic cylinder that can be actuated to impart forward or rearward movement to the clamping assembly 24 as will be described. In some embodiments, more than one skew cylinder 34 is utilized.

Referring to FIGS. 3 and 4, the clamping assembly 24 is further coupled to a pair of lining cylinders 36 that are coupled to the frame 18 and extend laterally inwardly towards one another. The inward ends of the lining cylinders 36 are operatively coupled to the clamping assembly 24. In some embodiments, the lining cylinders 36 may be coupled to a forwardly disposed flange 38 extending from the clamping assembly 24. The lining cylinders may be actuated to impart lateral movement (relative to the rails 14) to the clamping assembly 24 as will be described. In some embodiments, multiple lining cylinders may be utilized on each side of the clamping assembly 24.

Referring again to FIGS. 2-4, the clamping assembly 24 further includes a plurality of roller clamps 40, which are adapted to engage and roll along the rails 14. As such, in an operating the position, the roller clamps 40 may be rotated to position a lower flange portion 42 adjacent to the intersection of the top portion 44 of the I-beam profile of the rails 14 and a stem potion 46 of the rails. In this manner, the roller clamps 40 are able to engage the rail 12 at an upper portion of the rail. Each roller clamp 40 is respectively free to rotate about its own central axis and thus the roller clamps are adapted to roll along the rail during operation. Such an arrangement allows for quick engagement of the rail in contrast to machines that require lowering of the roller clamps into engagement with the rails each time a lifting action is required. The arrangement according to the present disclosure is particularly desirable during continuous rail operations, such as continuous tamping.

When lifting, and/or lining operations are desired, the roller clamps 40 may be actuated to "grip" the rails 14. For example, during a lifting operation the roller clamps 40 may be actuated to apply a laterally directed force against the rails 14 to thereby grip the rails 14. The jack cylinder 30 may then be actuated to lift the rails 14 from the ballast. The lifting operation facilitates lining operations. For example, upon lifting of the rails 14, the lining cylinders 36 may be actuated to impart lateral force to the clamp assembly 24, and therefore, the rails 14 to thereby move the rails in a lateral direction in accordance with desired lining requirements. Additionally, the skew cylinder 34 may be actuated to impart longitudinal force to the clamping assembly 24 to thereby move the clamping assembly relative to the machine frame 18.

Figure 6:
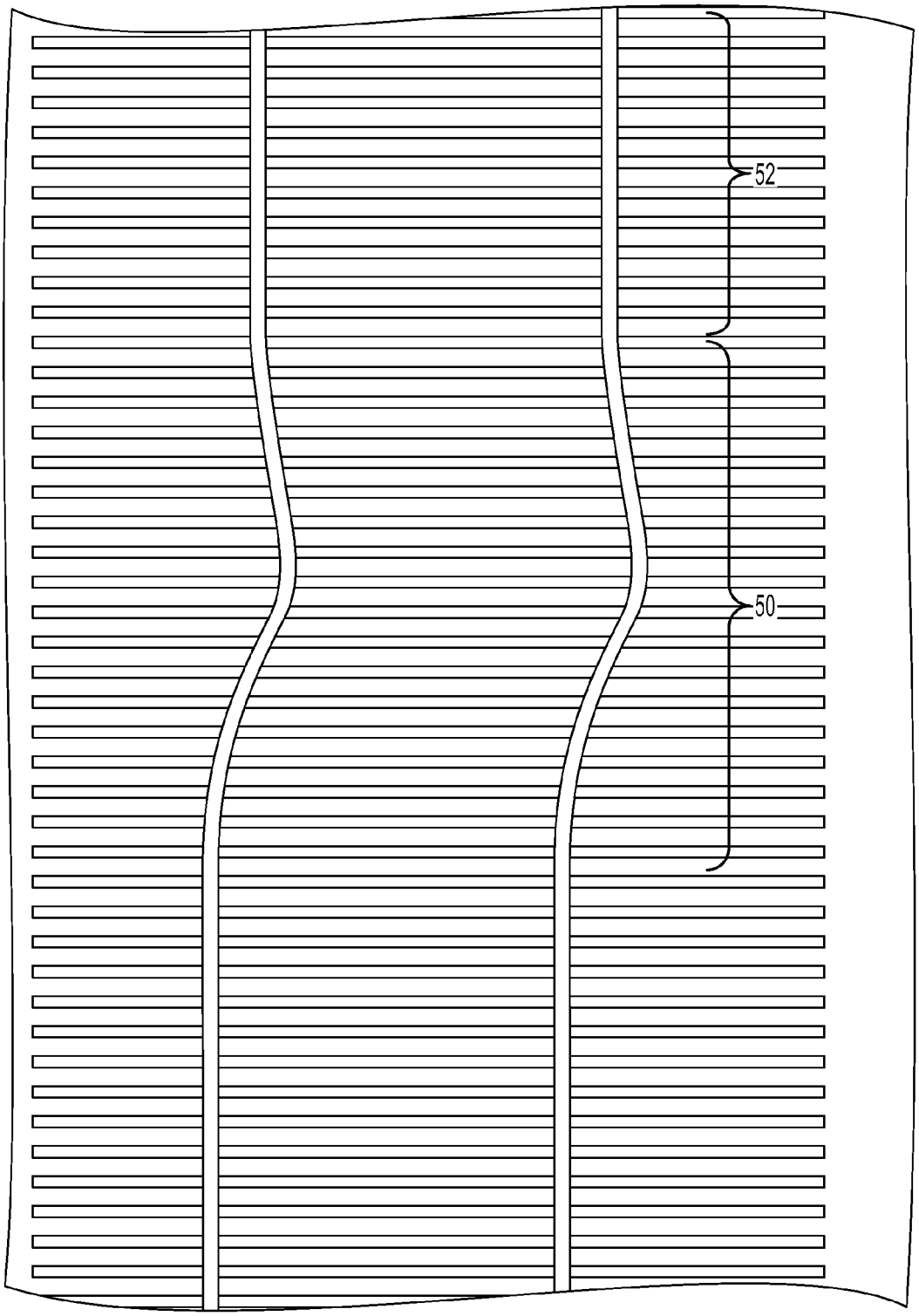
FIG. 6 illustrates a railroad having undergone a sun kink.

In some instances, it may be desirable to utilize the clamping assembly 24 for other operations other than continuous tamping operations. For example, it may be desired to use the clamping assembly to address poor track alignment, without carrying out the tamping operation. One such condition is caused during periods of particularly intense heat. Thermal expansion may cause rails to lengthen, thus causing track sections to form what is often referred to as a "sun kink." Sun kinks often exhibit extreme lateral track movement. Referring to FIG. 6, a sun kink 50 is shown in which the rails 14 have been deformed from their substantially parallel profile (when viewed in plan and referred to as reference numeral 52 in FIG. 6) to have a sinusoidal profile. As can be appreciated, sun kinks such as the one depicted in FIG. 6 can lead to catastrophic train derailments.

With reference again to FIGS. 2-5, the rail maintenance vehicle 10 may be equipped with a towing arm 54, which is movable from a first, unengaged position to a second, engaged position as will be described. The towing arm 54 may be operatively coupled to the frame 18 via a hydraulic cylinder 56 that is adapted to impart force to the towing arm. In some embodiments, the towing arm cylinder 56 is coupled to a flange member 58 extending from a crossbar 60 of the frame 18. The towing arm 54 includes a longitudinal portion 62 having a proximal portion 64, which is operatively coupled to a hinged portion 66 of the frame 18 depending downwardly from the crossbar 60. In this manner, the towing arm 54 is adapted to rotate relative to the crossbar 60 when actuated by the towing arm cylinder 56. The towing arm 54 further includes a distal portion 68 such that the distal end of the distal portion is substantially perpendicular to the longitudinal portion 62 of the towing arm. In some embodiments, the transition from the longitudinal portion 62 to the distal portion 68 takes on a curved configuration. Of course, other embodiments are contemplated in which the longitudinal portion and distal portion cooperate to form an L-shape in profile, for example.

Figure 5:
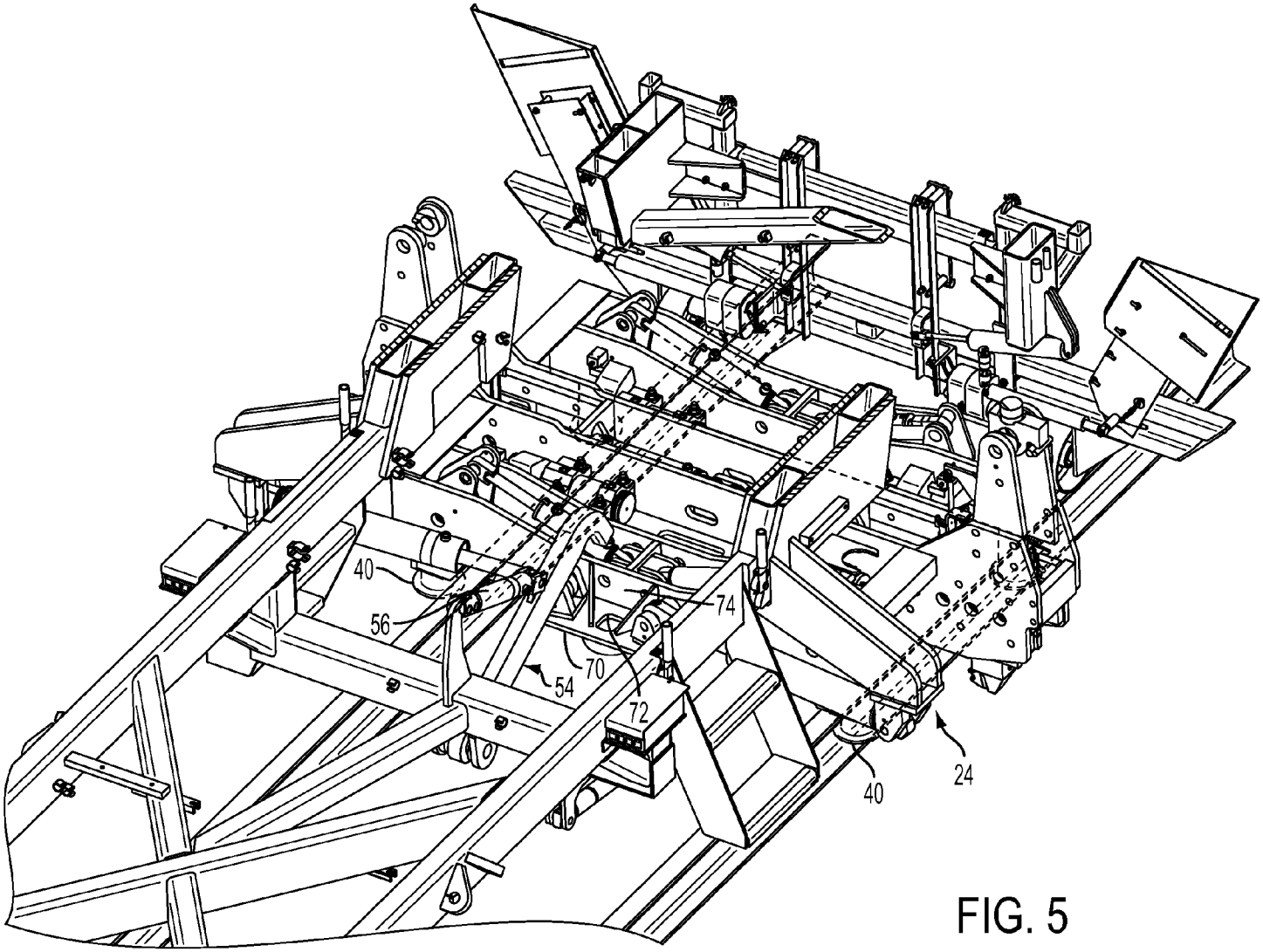
FIG. 5 illustrates a perspective view of the clamping assembly.

Referring specifically to FIG. 5, the clamping assembly 24 includes a hitch member 70 having an opening 72 defined there through. The opening 72 is sized and shaped to permit receipt of the distal portion 68 of the towing arm 54. In this manner, the towing arm 54 may engage the clamping assembly 24 for towing purposes.

In practice, the towing arm 54 is initially in an up position and not engaged with the clamping assembly 24. Such an arrangement may be desired during tamping operations where the rail vehicle 10 is moving at relatively low speeds. With specific reference to FIG. 2, the clamping assembly 24 is coupled to the frame 18 of the rail vehicle 10 via the jack cylinder 30, and skew cylinder 34. This coupling is suitable for low-speed tamping or other maintenance operations. However, in certain circumstances, it may be desirable to further couple the clamping assembly 24 to the frame 18 and impart force in the longitudinal direction. Accordingly, the towing arm 54 may be actuated via the towing arm hydraulic cylinder 56 from an unengaged position into an engaged position in which the towing arm operatively couples to the clamping assembly 24 via insertion of the distal portion 68 of the towing arm into the hitch member 70.

Upon coupling of the towing arm 54 to the clamping assembly 24, the rail vehicle 10 may be operated in continuous fashion as the towing arm provides additional towing force in the longitudinal direction. In this regard, the towing arm 54 connection to the clamping assembly 24 is at a desired position on a forward facing portion 74 of the clamping assembly. With this arrangement, the rail vehicle 10 may be operated over a sun kink (see, e.g., sun kink 50 in FIG. 6) to tow the clamping assembly at a continuous speed to correct the sun kink deformation and bring the rails 14 back into a desired parallel, or substantially parallel relationship. Towing the clamping assembly along the rails 14 at a desirable rate of speed effectively irons out the sun kink via the forces imparted to the rails by the flanged wheels 39 and roller clamps 40 as they roll along with and engage the rails. Accordingly, the rail vehicle 10 according to the present disclosure is capable of performing not only tamping, lifting, and lining operations, but may be further modified via engagement of the towing arm 54 of the clamp assembly 24 to address sun kinks in the rails 14.

Referring again to FIG. 1, in some embodiments, a processor 76, for example mounted to the frame 18, may be coupled to the motor, the work head portion 22, the clamp assembly 24, the towing arm 54 (including the various hydraulic cylinders described herein) to control the operation of the various components of the rail maintenance vehicle 10 and provide, by way of example, the functionality described herein. In some embodiments, the described processes herein may be executed by a controller, a special purpose processor/computer or a general purpose processor programmed to execute the process. The process may also be in the form of computer executable instructions that, when executed by a processor, cause the processor to execute the correction process. The computer executable instructions may be stored on one or more computer readable mediums in whole or in parts. The instructions and/or the processor programmed to execute the process may be provided onboard the vehicle, which may be an autonomous vehicle, in a device external to the vehicle (for example, on an operator control interface or another piece of work equipment) that is in communication with the vehicle, or a combination thereof.

Figure 7:
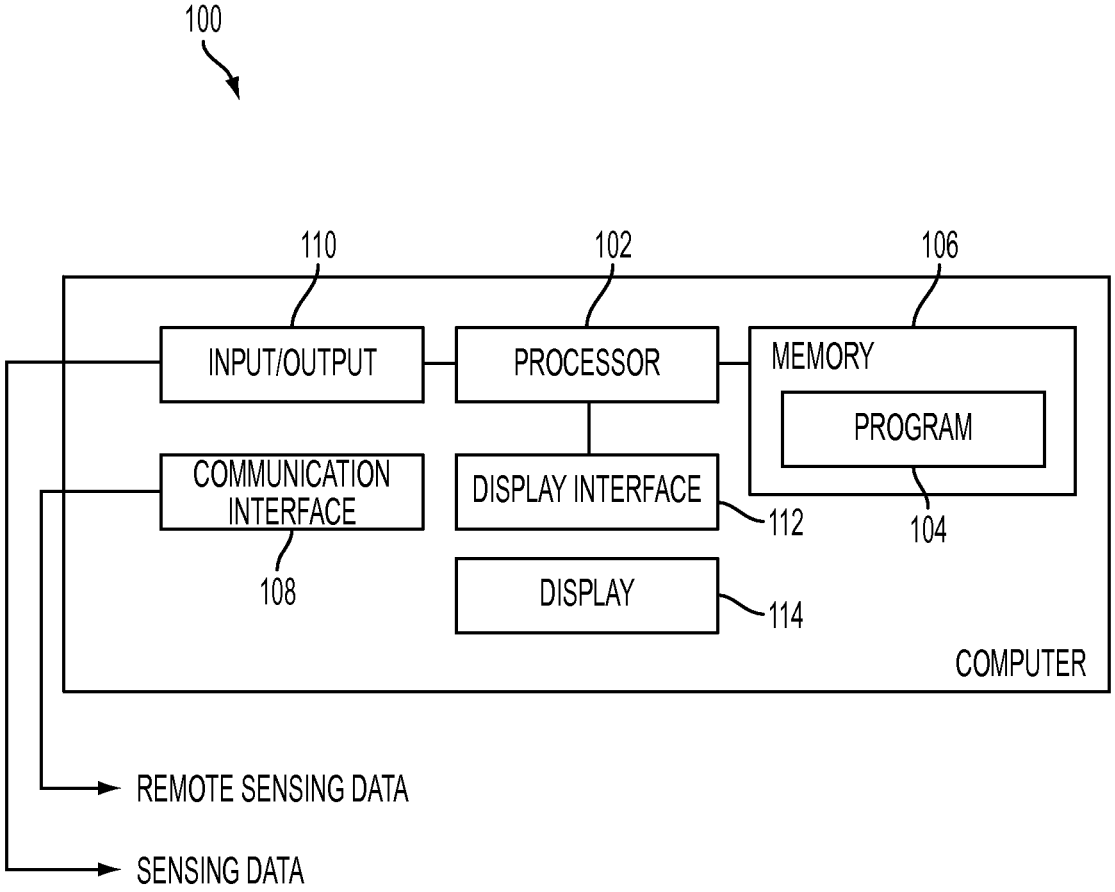
FIG. 7 illustrates a data processing system for carrying out methods according to the present disclosure.

For example, referring to FIG. 7, some embodiments of a computer or data processing system 100 may include the processor 76 configured to execute at least one program 104 stored in a memory 106 for the purposes of processing data to perform one or more of the techniques that are described herein. The processor 76 may be coupled to a communication interface 108 to receive remote sensing data. The processor 76 may also receive the sensing data via an input/output block 110. In addition to storing instructions for the program, the memory 106 may store preliminary, intermediate and final datasets involved in the techniques that are described herein. Among its other features, the computer or data processing system 100 may include a display interface 112 and a display 114 that displays the various data that is generated as described herein. It will be appreciated that the computer or data processing system 100 shown in FIG. 7 is merely exemplary (for example, the display may be separate from the computer, omitted, etc) in nature and is not limiting of the systems and methods described herein.

While various embodiments in accordance with the disclosed principles have been described above, it should be understood that they have been presented by way of example only, and are not limiting. Thus, the breadth and scope of the invention(s) should not be limited by any of the above-described exemplary embodiments, but should be defined only in accordance with the claims and their equivalents issuing from this disclosure. Furthermore, the above advantages and features are provided in described embodiments, but shall not limit the application of such issued claims to processes and structures accomplishing any or all of the above advantages.

Additionally, the section headings herein are provided for consistency with the suggestions under 37 C.F.R. 1.77 or otherwise to provide organizational cues. These headings shall not limit or characterize the invention(s) set out in any claims that may issue from this disclosure. Specifically and by way of example, a description of a technology in the "Background" is not to be construed as an admission that technology is prior art to any invention(s) in this disclosure. Neither is the "Summary" to be considered as a characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of such claims shall be considered on their own merits in light of this disclosure, but should not be constrained by the headings set forth herein.

The invention claimed is:

1. A rail vehicle, comprising:

a frame;

a clamping assembly coupled to the frame;

a towing arm coupled to the frame and disposed forward of the clamping assembly, the towing arm operable to selectively connect to and disconnect from the clamping assembly, wherein the towing arm has a first end hingedly coupled to the frame and the towing arm connects to the clamping assembly when rotated to a first position and disconnects from the clamping assembly when rotated to a second position; and an actuator coupled between the frame and the towing arm, the actuator being operable to rotate the towing arm between the first and second positions.

2. A rail vehicle according to claim 1, wherein the clamping assembly is coupled to the frame via a vertically disposed hydraulic cylinder.

3. A rail vehicle according to claim 2, wherein the vertically disposed hydraulic cylinder is operable to vertically displace the clamping assembly.

4. A rail vehicle according to claim 1, wherein the clamping assembly comprises at least two roller clamps, the roller clamps being respectively coupled to opposing sides of the clamping assembly.

5. A rail vehicle according to claim 4, wherein the roller clamps each have a central axis, each roller clamp being operable to rotate about its central axis during movement of the rail vehicle along rails.

6. A rail vehicle according to 1, further comprising a pair of hydraulic cylinders coupled to the clamping assembly and disposed laterally relative to the clamping assembly.

7. A rail vehicle according to claim 6, wherein the laterally disposed hydraulic cylinders are operable to laterally displace the clamping assembly.

8. A rail vehicle according to claim 1, further comprising a hydraulic cylinder having a first end coupled to the frame and having a second end coupled to the clamping assembly, the hydraulic cylinder extending longitudinally between the frame and the clamping assembly.

9. A rail vehicle according to claim 8, wherein the longitudinally disposed hydraulic cylinder is operable to longitudinally displace the clamping assembly.

10. A rail vehicle according to claim 1, wherein the towing arm has a second end operable to engage the clamping assembly.

11. A rail vehicle according to claim 10, wherein the clamping assembly comprises a hitch portion having an opening defined there through for receiving the towing arm.

12. A rail vehicle according to claim 1, wherein the towing arm has a longitudinal portion, and a distal portion extending substantially perpendicular to the longitudinal portion.

13. A rail vehicle according to claim 1, wherein the towing arm includes a longitudinal portion and a distal portion angled from the longitudinal portion, the clamping assembly includes an opening sized and shaped to permit receipt of the distal portion, and the distal portion is disposed at least partially inside the opening in the first position.

* * * * *